US010679807B2

(12) United States Patent
Meley et al.

(10) Patent No.: US 10,679,807 B2
(45) Date of Patent: Jun. 9, 2020

(54) POWER BREAKING DEVICE

(71) Applicant: SCHNEIDER ELECTRIC INDUSTRIES SAS, Rueil Malmaison (FR)

(72) Inventors: Jean-Pierre Meley, Saint-Ismier (FR); Florent Berardengo, Saint Martin le Vinoux (FR)

(73) Assignee: SCHNEIDER ELECTRIC INDUSTRIES SAS, Rueil Malmaison (FR)

( * ) Notice: Subject to any disclaimer, the term of this patent is extended or adjusted under 35 U.S.C. 154(b) by 0 days.

(21) Appl. No.: 16/053,861

(22) Filed: Aug. 3, 2018

(65) Prior Publication Data

US 2019/0066950 A1 Feb. 28, 2019

(30) Foreign Application Priority Data

Aug. 28, 2017 (FR) ..... 17 57913

(51) Int. Cl.
*H01H 9/02* (2006.01)
*H01H 33/662* (2006.01)
(Continued)

(52) U.S. Cl.
CPC ..... *H01H 33/66207* (2013.01); *H01H 9/02* (2013.01); *H01H 33/6606* (2013.01);
(Continued)

(58) Field of Classification Search
CPC ..... H01H 9/02; H01H 9/0242; H01H 2009/0285; H01H 33/66207;
(Continued)

(56) References Cited

U.S. PATENT DOCUMENTS 5,864,108 A * 1/1999 Rohling ..... H01H 33/666 218/134
6,410,875 B2 * 6/2002 Allard ..... H01H 1/5822 218/118
(Continued)

FOREIGN PATENT DOCUMENTS

EP 1 160 816 A1 12/2001
EP 2 261 941 A1 12/2010
(Continued)

OTHER PUBLICATIONS

Translation of EP1160816 (original document published Dec. 5, 2001 (Year: 2001).*
(Continued)

*Primary Examiner* — William A Bolton
(74) *Attorney, Agent, or Firm* — Oblon, McClelland, Maier & Neustadt, L.L.P.

(57) ABSTRACT

A power breaking pole including a vacuum interrupter including two ends called a lower end and an upper end, respectively, which vacuum interrupter is held between two uprights, which are arranged symmetrically with respect to a main plane P of the vacuum interrupter, the vacuum interrupter being held in a centred manner between the two uprights solely by two connectors called a lower connector and an upper connector, respectively.

16 Claims, 3 Drawing Sheets

(51) Int. Cl.
*H01H 33/66* (2006.01)
*H01H 33/666* (2006.01)

(52) U.S. Cl.
CPC ..... *H01H 33/66261* (2013.01); *H01H 2033/6623* (2013.01); *H01H 2033/6665* (2013.01); *H01H 2033/66276* (2013.01)

(58) Field of Classification Search
CPC ..... H01H 33/66261; H01H 33/6606; H01H 33/66; H01H 11/0031; H01H 2033/6623; H02B 5/02
USPC ..... 218/139, 134, 155, 118
See application file for complete search history.

(56) References Cited

U.S. PATENT DOCUMENTS 9,460,868 B2 * 10/2016 Hyrenbach ..... H01H 33/666
10,153,110 B2 * 12/2018 Inoue ..... H01H 33/6606
2005/0029001 A1 * 2/2005 Sato ..... H01B 3/02 174/50
2011/0000886 A1 1/2011 Isoya et al.
2016/0012985 A1 1/2016 Tortorici et al.
2016/0284485 A1 9/2016 Berardengo et al.

FOREIGN PATENT DOCUMENTS

EP 2 966 666 A1 1/2016
EP 3 073 505 A1 9/2016

OTHER PUBLICATIONS

French Preliminary Search Report dated May 18, 2018 in French Application 17 57913 filed on Aug. 28, 2017 (with English Translation of Categories of cited documents & Written Opinion).

* cited by examiner

POWER BREAKING DEVICE

TECHNICAL FIELD

The present invention relates to a power breaking pole comprising a vacuum interrupter held in a centered manner by two connectors between two lateral uprights, also called stays. In particular, the present invention relates to a power breaking pole having a modular architecture making it possible to consider a single type of holding and centering lateral upright regardless of the voltage and current ranges covered by the vacuum interrupter.

The present invention also relates to a method of assembling the power breaking pole.

PRIOR ART

A power breaking pole known to a person skilled in the art generally comprises a vacuum interrupter which has a fixed contact cooperating with a mobile contact, in order to break, in the vacuum in complete safety, a current flowing in the pole. Such a vacuum interrupter is particularly used in the field of high-voltage, i.e. a voltage greater than 1000 V. The vacuum interrupter has an upper end linked to the fixed contact and a lower end linked to the mobile contact. It is held between two uprights symmetrically placed with respect to a main axis of the vacuum interrupter.

The pole also comprises two connectors each in contact with one of the two ends of the vacuum interrupter and which are intended to provide an electrical connection with the terminals of the vacuum interrupter (throughout the application, the terms "terminal" and "end" are interchanged).

Holding and centering the vacuum interrupter with respect to the uprights also requires a linking unit intended to rigidly interlink the two uprights. In other words, the linking unit provides the mechanical cohesion of the power breaking pole.

However, this device known from the prior art is not satisfactory.

Indeed, the linking unit must be adjusted to the dimensions (in other words to the size) of the vacuum interrupter used in the power breaking pole.

Moreover, taking into consideration the linking unit complicates the assembling of the power breaking pole, and produces an additional cost which is preferably avoided.

An aim of the present invention then is to propose a power breaking pole in which the number of elements to be assembled is reduced with respect to the poles known from the prior art.

Another aim of the present invention is to propose a power breaking pole in which the vacuum interrupter is interchangeable with another vacuum interrupter having different geometric features without having to modify the upright linking system.

DISCLOSURE OF THE INVENTION

The aims of the present invention are at least partially achieved by a method of assembling a power breaking pole, the assembling method comprising the following steps:

a) providing two uprights supplied with upper and lower holding means;

b) providing a vacuum interrupter chosen from a plurality of vacuum interrupters each covering a range of different voltages and currents, each comprising an upper end and a lower end, and extending along an elongation axis, called an axis XX', in alignment with the upper and lower ends;

c) providing two connectors, called an upper connector and a lower connector, respectively, which are specific to the vacuum interrupter chosen in step b), d) fixing the upper and lower connectors to the upper and lower holding means, respectively, such as to rigidly hold the two uprights together, the two connectors also holding, in a centered manner, the vacuum interrupter chosen in step b) between said two uprights, said two uprights being placed symmetrically with respect to a main plane P of the vacuum interrupter, the upper and lower holding means also being arranged to allow the two connectors to hold vacuum interrupters with different lengths along the axis XX'.

According to an embodiment, the upper and lower holding means comprise, on each upright, an upper section and a lower section, each upper or lower section comprising two mainly parallel faces called a lower face and an upper face, respectively, and which are perpendicular to the axis XX'.

According to an embodiment, the upper connector is mounted to bear either against the upper faces or against the lower faces of the two upper sections depending on the length of the vacuum interrupter chosen in step b).

According to an embodiment, the lower connector is mounted to bear either against the upper faces or against the lower faces of the two lower sections depending on the length, along the axis XX', of the vacuum interrupter chosen in step b).

According to an embodiment, the upper and lower holding means further comprise fastening means, the fastening means being intended to fix the upper and lower connectors to said upper and lower holding means.

According to an embodiment, the fastening means comprise one or more rows of tapped holes in alignment with the section on which they are formed.

According to an embodiment, the two connectors are fixed to the fastening means by screws.

According to an embodiment, the lower connector is electrically linked to the lower end of the vacuum interrupter via an electrical link, the electrical link advantageously comprising an assembly of layered metal blades.

According to an embodiment, the vacuum interrupter is chosen from a plurality of vacuum interrupters each covering a range of different voltages and currents, wherein each vacuum interrupter can be held in a centered manner between the two uprights by specific upper and lower connectors.

The invention also relates to a kit comprising two uprights, a plurality of vacuum interrupters each covering a range of different voltages and currents, each comprising an upper end and a lower end, and a plurality of upper and lower connectors.

The invention also relates to a power breaking pole intended for an electric switching device, comprising:

- a vacuum interrupter, which extends along an elongation axis called an axis XX', said interrupter being equipped with a lower end and an upper end in alignment with the axis XX',
- two uprights placed symmetrically with respect to a main plane P of the vacuum interrupter, the two uprights being supplied with upper and lower holding means,
- a lower connector and an upper connector, which are electrically linked to the lower end and to the upper end, respectively, the upper and lower connectors being fixed to the upper and lower holding means, respectively, such as to rigidly hold the two uprights together, the two connectors also holding the vacuum interrupter in a centered manner between said two uprights, the upper and lower holding means also being arranged to allow the two connectors to hold vacuum interrupters with different lengths along the axis XX'.

According to an embodiment, the upper and lower holding means comprise, on each upright, an upper section and a lower section, each upper or lower section comprising two mainly parallel faces called a lower face and an upper face, respectively, and which are perpendicular to the axis XX'.

According to an embodiment, the upper connector is mounted to bear either against the upper faces or against the lower faces of the two upper sections depending on the length of the vacuum interrupter chosen in step b).

According to an embodiment, the lower connector is mounted to bear either against the upper faces or against the lower faces of the two lower sections depending on the length, along the axis XX', of the vacuum interrupter chosen in step b).

BRIEF DESCRIPTION OF THE DRAWINGS

Other features and advantages will appear in the following description of the power breaking pole according to the invention, which are given as nonlimiting examples, with reference to the appended drawings wherein:

FIG. 2 illustrates the interchangeability of the vacuum interrupters that can be held in a centered manner between the two lateral uprights;

DETAILED DISCLOSURE OF SPECIFIC EMBODIMENTS

The present invention proposes a new architecture for a power breaking pole comprising a vacuum interrupter. In particular, the present invention uses a vacuum interrupter held and centered between two uprights (also called lateral uprights, the two lateral uprights forming a frame of the power breaking pole) via only two connectors (also called electrical connectors and allowing an electrical connection of the terminals of the vacuum interrupter).

Figure 1:
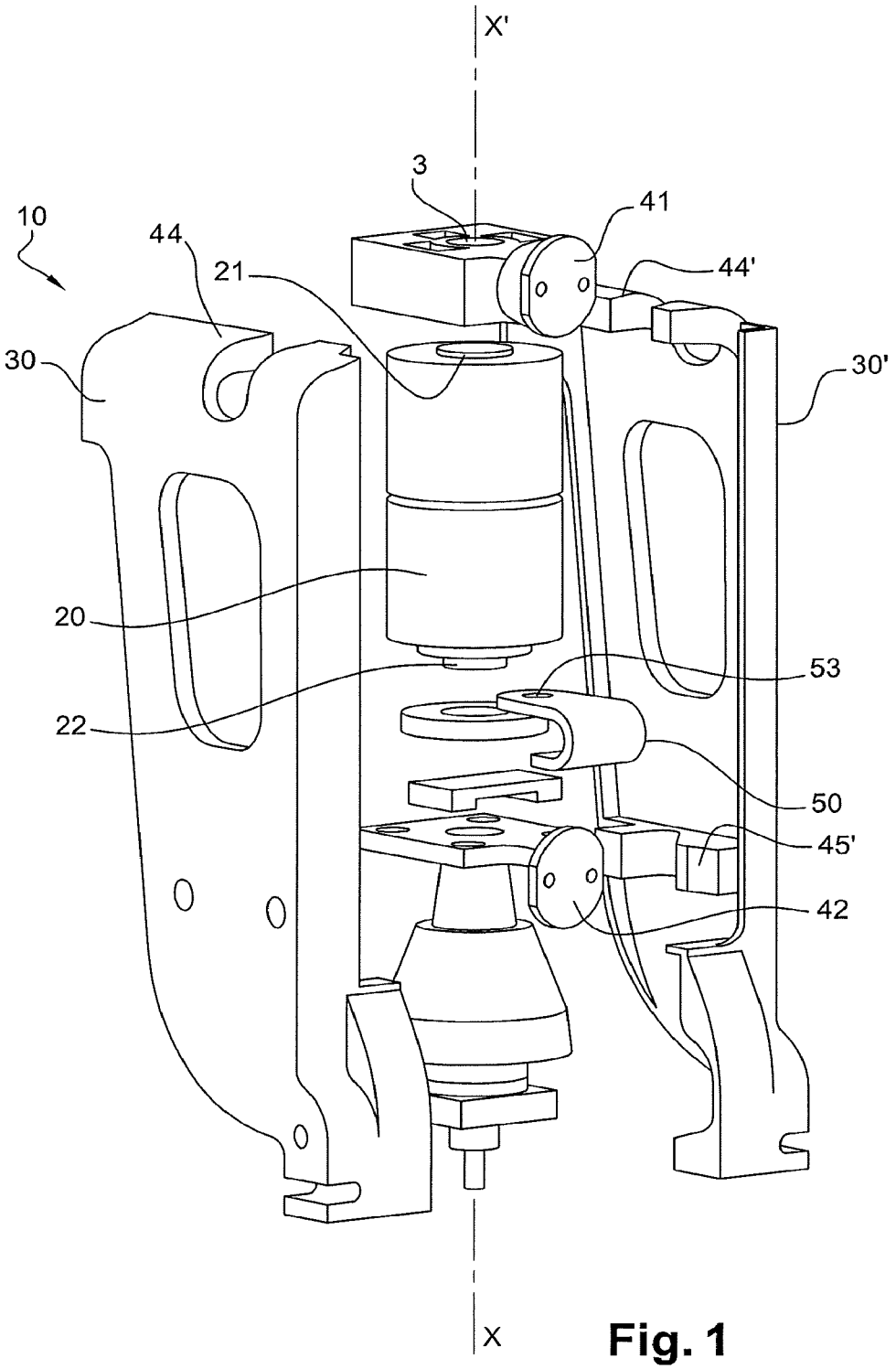
FIG. 1 is a perspective and an exploded representation of a power breaking pole according to the present invention.

FIG. 1 shows a power breaking pole 10 according to the present invention.

The power breaking pole 10 comprises a vacuum interrupter 20.

The vacuum interrupter 20 comprises two ends called an upper end 21 and a lower end 22, respectively.

Each of the ends 21 and 22 of the vacuum interrupter 20 is also referred to as an electrical terminal of said interrupter 20.

The vacuum interrupter 20 therefore comprises an upper electrical terminal placed at the upper end 21 and as a continuation of the vacuum interrupter 20 along the main axis XX'.

In the same way, the vacuum interrupter 20 therefore comprises a lower electrical terminal placed at the lower end 22, and as a continuation of the vacuum interrupter 20 along the main axis XX'.

The vacuum interrupter 20 extends along a main axis XX'. More specifically, the main axis XX' is an axis of rotational symmetry of the vacuum interrupter 20.

The power breaking pole 10 further comprises two uprights 30 and 30' (also called lateral uprights). In particular, the uprights 30 and 30' are placed laterally with respect to the vacuum interrupter 20, symmetrically with respect to a main plane P of the vacuum interrupter 20. Main plane P means a plane passing through the main axis XX' of the vacuum interrupter.

The two uprights 30 and 30' can advantageously be made from an electrically insulating material. In particular, the insulating material can comprise at least one of the materials chosen from: thermoplastic of polyimide, polyphtalamide and thermosetting type of SMC, BMC, epoxy type.

According to the invention, the vacuum interrupter 20 is held in a centered manner between the two uprights 30 and 30'. "In a centered manner between the two uprights" means that the main plane P of the vacuum interrupter 20 is at an equal distance from the two uprights.

Moreover, the two uprights 30 and 30' partially wrap around the vacuum interrupter 20.

The uprights 30 and 30' can also comprise fixing means intended to fix the power breaking pole 10 on a support that is not shown in the figures. Said fixing means can advantageously cooperate with screws.

Moreover, the vacuum interrupter 20 is held in a centered manner between the two uprights 30 and 30' solely by two connectors called an upper connector 41 and a lower connector 42, respectively.

Figure 3:
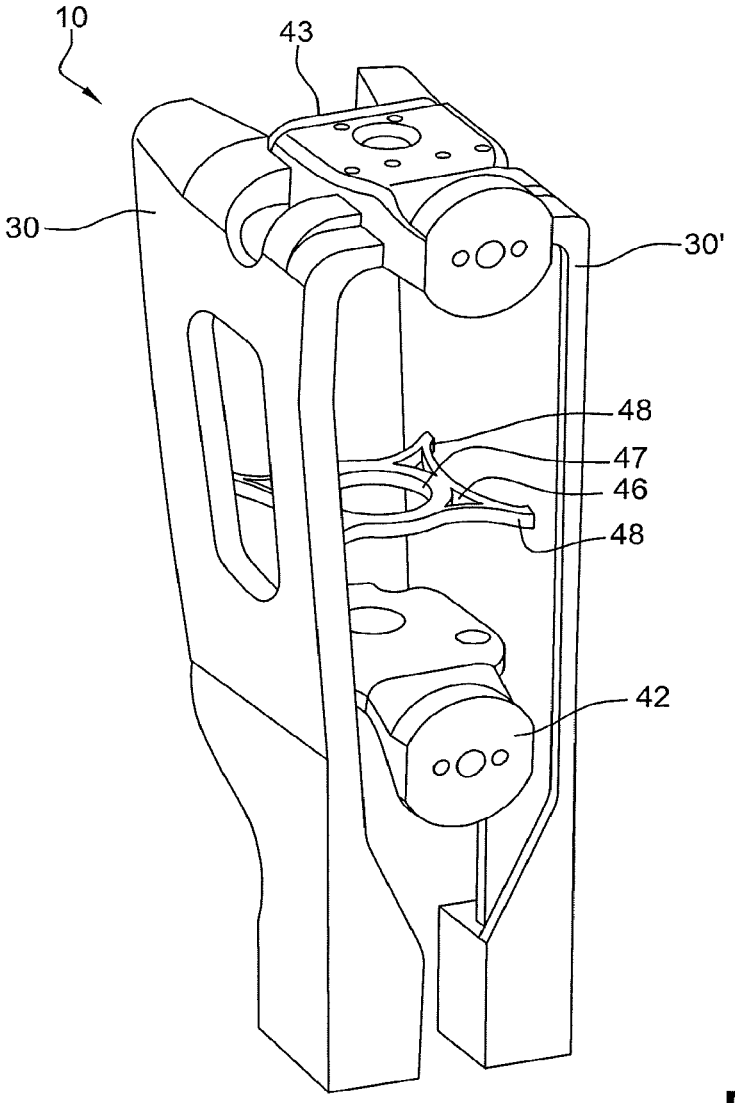
FIG. 3 is a perspective representation of a power breaking pole, in which the vacuum interrupter is not present, according to the present invention.

The pole according to the present invention can also comprise an interrupter guiding piece 46 (FIG. 3).

The guiding piece can have a generally planar shape, and be supplied with a bore hole 47 inside which the vacuum interrupter can be inserted.

In particular, the bore hole can have a shape that is complementary to the lateral outer surface of the vacuum interrupter.

The guiding piece can also comprise tabs 48*a*, in particular four tabs, which are intended to rest on notches formed on an internal surface of the uprights.

Holding the vacuum interrupter 20 solely by the two connectors 41 and 42 then makes it possible to do without any additional holding unit.

In particular and in an advantageous manner, the two uprights 30 and 30' are furthermore rigidly fixed to one another solely via the two connectors 41 and 42. "Rigidly fixed" to one another solely via the two connectors 41 and 42 means a pole having a mechanical integrity provided by the rigid fixing of the two uprights by the two connectors 41 and 42.

It is therefore not necessary to have to use an additional linking unit in order to provide the mechanical cohesion of the power breaking pole.

The connectors 41 and 42 can be fixed to the uprights 30 and 30' by screws. However, the invention should not be limited to this type of fixing, and a clip and/or fitting system can alternatively be envisaged.

In this respect, the two uprights 30 and 30', respectively, can be supplied with upper holding means 44 and 44', respectively, on which the upper connector 41 is fixed. The upper holding means 44, 44' each comprise a section, called an upper section. Each upper section extends, for example, from each upright toward the inside of the pole according to the present invention and comprises two mainly parallel faces called a lower face and an upper face, respectively, that are substantially perpendicular to the main axis XX'.

Figure 2:
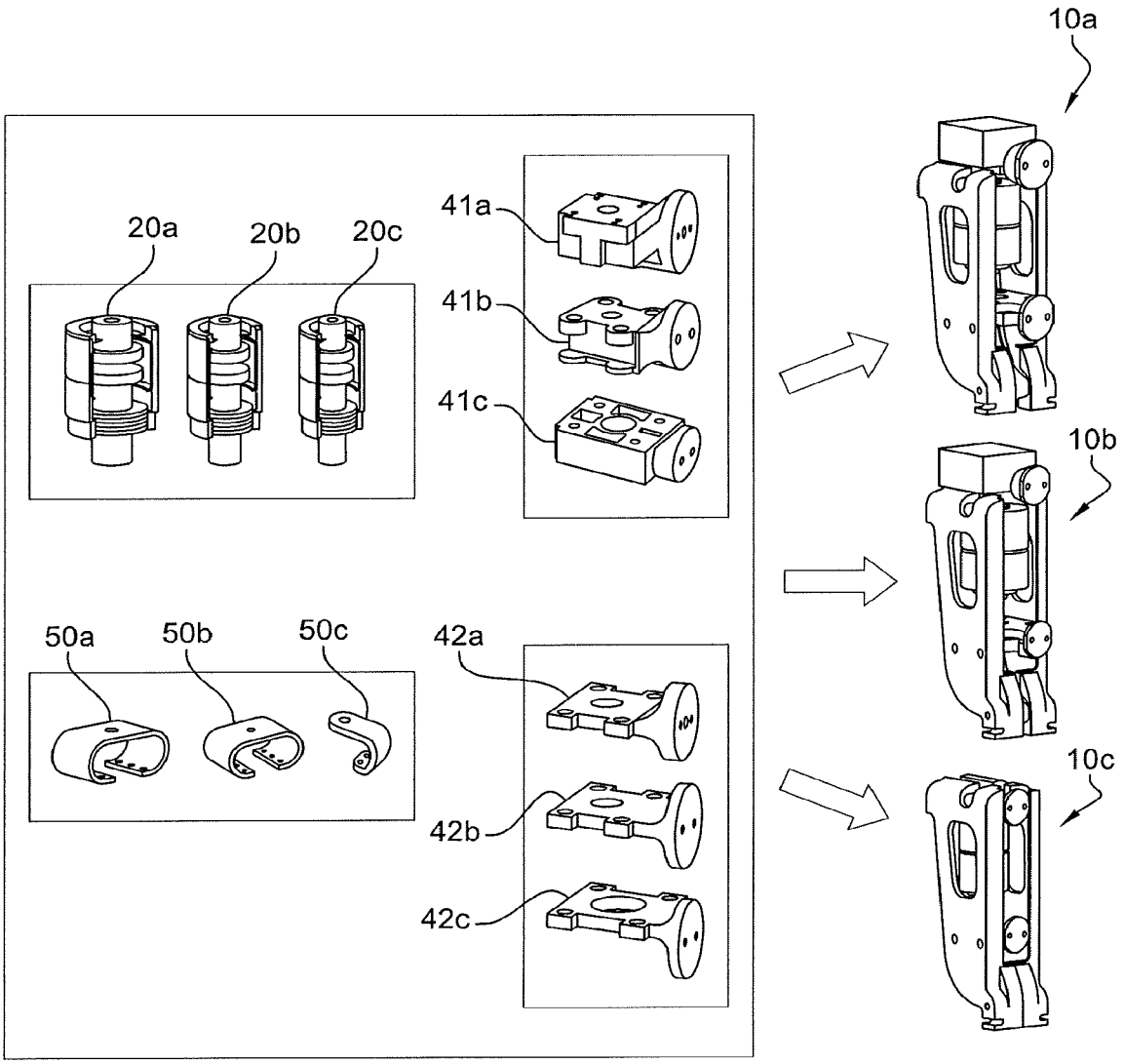
FIG. 2 is a representation of the modularity of the power breaking pole according to the invention, in particular.

The upper connector 41 can be fixed to the upper holding means 44, 44' either by the upper face of the upper holding means 44, 44' (FIG. 2, pole 10*a*), or by the lower face of the upper holding means 44, 44' (FIG. 2, pole 10*c*). Alternatively, the upper holding means 44, 44' can be engaged by sliding in a groove positioned on the lateral surface of the upper connector 41 (FIG. 2, element 41*b*).

The upper holding means 44, 44' can also be supplied with tapped holes allowing the connector 41 to be screwed onto said holding means.

Likewise, the two uprights 30 and 30', respectively, can be supplied with lower holding means 45 and 45', respectively, on which the lower connector 42 is fixed, and which lower holding means can mainly take the features of the upper holding means 44, 44'.

Advantageously, this arrangement of the upper and lower holding means makes it possible to vary the distance between the lower 42 and upper 41 connectors, and therefore to vary the size of the vacuum interrupter, in particular the length thereof along the axis XX' thereof.

It is clear, without it being necessary to specify, that the connectors 41 and 42 can be specific to the vacuum interrupter 20 used in the power breaking pole 10. In other words, the connectors 41 and 42 can be dependent upon the geometric features of the vacuum interrupter 20 in question.

Moreover, it is notable that the connectors 41 and 42 provide the electrical connection with the upper and lower terminals, respectively, of the vacuum interrupter 20.

The connector 41 indeed provides a direct electrical contact with the upper terminal of the vacuum interrupter ("direct electrical contact" means a physical contact between an electrical terminal of the connector and a terminal of the interrupter).

The upper connector 41 can comprise a bore hole 43 inside which the upper electrical terminal of the vacuum interrupter 20 is engaged. More particularly, the upper electrical terminal comprises a shape complementary to the bore hole 43 of the upper connector 41 such as to prevent any movement of the vacuum interrupter 20 in the directions perpendicular to the main axis XX'.

The lower connector 42 can be electrically linked to the lower end 22 of the vacuum interrupter 20 via an electrical link 50, the electrical link advantageously comprising a set of layered metal blades (this electrical link is also called a "shunt"). This electrical link 50 is flexible since the lower end 22 corresponds to the mobile end which is linked to the mobile contact of the vacuum interrupter. It is also specific to the vacuum interrupter 20 in question. In particular, the electrical link 50 has a geometry which is specific to the geometry of the vacuum interrupter in question. This electrical link 50 is particularly advantageous once the lower connector 42 and the lower electrical terminal of the vacuum interrupter 20 are at a distance from one another when they are fixed between the two uprights 30 and 30'.

The electrical link 50 can comprise a bore hole 53 inside which the lower electrical terminal of the vacuum interrupter 20 is engaged. More particularly, the lower electrical terminal comprises a shape complementary to the bore hole 53 of the electrical link 50 such as to prevent any movement of the vacuum interrupter 20 in the directions perpendicular to the main axis XX'.

The arrangement of the power breaking pole according to the present invention is modular. Indeed, in a same frame (the two uprights 30 and 30'), it is possible to mount various types of vacuum interrupters.

In other words, for a same frame, the vacuum interrupter 20 can be chosen from a plurality of vacuum interrupters each covering a range of different voltages and currents, wherein each vacuum interrupter of said plurality of interrupters can be held in a centered manner between the two uprights by specific upper and lower connectors.

In this respect, FIG. 2 illustrates the assembling of three power breaking poles comprising the same lateral uprights 30 and 30'.

The first of these three poles 10*a* comprises a vacuum interrupter 20*a*, an upper connector 41*a*, a lower connector 42*a* and a shunt 50*a*. The second of these three poles 10*b* comprises a vacuum interrupter 20*b*, an upper connector 41*b*, a lower connector 42*b* and a shunt 50*b*. The third of these three poles 10*c* comprises a vacuum interrupter 20*c*, an upper connector 41*c*, a lower connector 42*c* and a shunt 50*c*.

The first pole 10*a*, the second pole 10*b* and the third pole 10*c* can thus operate in the current ranges of, for example, 2500-3150 amps, 1600-2000 amps and 630-1250 amps, respectively.

The invention also relates to a method of assembling the power breaking pole, the assembling method comprising the following steps:

a) providing two uprights 30, 30' supplied with upper 44, 44' and lower 45, 45' holding means;

b) providing a vacuum interrupter chosen from a plurality of vacuum interrupters each covering a range of different voltages and currents, each comprising an upper end 21 and a lower end 22, each of the vacuum interrupters extending along an elongation axis, called an axis XX', in alignment with the upper 21 and lower 22 ends of said vacuum interrupter;

c) providing two connectors, called an upper connector 41 and a lower connector 42, respectively, which are specific to the vacuum interrupter chosen in step b), d) fixing the upper 41 and lower 42 connectors to the upper 44, 44' and lower 45, 45' holding means, respectively, such as to rigidly hold the two uprights 30, 30' together, the two connectors 41, 42 also holding, in a centered manner, the vacuum interrupter chosen in step b) between said two uprights (30, 30'), said two uprights being placed symmetrically with respect to a main plane P of the vacuum interrupter, the upper 44, 44' and lower 45, 45' holding means also being arranged to allow the two connectors 41, 42 to hold interrupters with different lengths along the axis XX'.

Advantageously, the upper 44, 44' and lower 45, 45' holding means can comprise, on each upright 30, 30', an upper section 44, 44' and a lower section 45, 45'. In particular, each upper 44, 44' or lower 45, 45' section comprises two mainly parallel faces called a lower face and an upper face, respectively, and which are perpendicular to the axis XX'.

The upper connector 41 can be mounted to bear either against the upper faces or against the lower faces of the two upper sections 44, 44' depending on the length of the vacuum interrupter chosen in step b).

Additionally or alternatively, the lower connector 42 can be mounted to bear either against the upper faces or against the lower faces of the two lower sections 45, 45' depending on the length, along the axis XX', of the vacuum interrupter chosen in step b).

The upper and lower holding means can further comprise fastening means, the fastening means being intended to fix the upper and lower connectors to said upper and lower holding means.

In particular, the fastening means comprise one or more rows of tapped holes in alignment with the section on which they are formed.

The two connectors can be fixed to the fastening means by screws.

The invention also relates to a kit for implementing the method of assembling the power breaking pole 10. Thus, the kit advantageously comprises two uprights, a plurality of vacuum interrupters each covering a range of different voltages and currents, each comprising an upper end 21 and a lower end 22, and a plurality of upper 41 and lower 42 connectors.

The invention claimed is:

1. A method of assembling a power breaking pole, the method comprising:

a) providing two uprights supplied with an upper holder and a lower holder;

b) providing a vacuum interrupter chosen from a plurality of vacuum interrupters each covering a range of different voltages and currents, each comprising an upper end and a lower end and extending along an elongation axis, called an axis XX', in alignment with the upper and lower ends;

c) providing two connectors, called an upper connector and a lower connector, respectively, which are specific to the vacuum interrupter chosen in b), d) fixing the upper and lower connectors to the upper holder and the lower holder, respectively, such as to rigidly hold the two uprights together, the two connectors also holding, in a centered manner, the vacuum interrupter chosen in b) between the two uprights, which are placed symmetrically with respect to a main plane P of the vacuum interrupter, the upper holder and the lower holder also being arranged to allow the two connectors to hold vacuum interrupters with different lengths, along the axis XX'.

2. The method according to claim 1, wherein the upper holder and the lower holder comprise, on each upright, an upper section and a lower section, each upper or lower section comprising two mainly parallel faces called a lower face and an upper face, respectively, and which are perpendicular to the axis XX'.

3. The method according to claim 2, wherein the upper connector is mounted to bear either against the upper face or against the lower face of the two upper sections depending on a length of the vacuum interrupter chosen in b).

4. The method according to claim 2, wherein the lower connector is mounted to bear either against the upper face or against the lower face of the two lower sections depending on a length, along the axis XX', of the vacuum interrupter chosen in b).

5. The method according to claim 2, wherein the upper holder and the lower holder further comprise a fastener, the fastener fixing the upper and lower connectors to said upper holder and the lower holder.

6. The method according to claim 5, wherein the fastener comprises one or more rows of tapped holes in alignment with a section on which the tapped holes are formed.

7. The method according to claim 5, wherein two connectors are fixed to the fastener by screws.

8. The method according to claim 1, wherein the lower connector is electrically linked to the lower end of the vacuum interrupter via an electrical link, the electrical link comprising an assembly of layered metal blades.

9. The method according to claim 1, wherein the vacuum interrupter is chosen from the plurality of vacuum interrupters each covering the range of different voltages and currents, wherein each vacuum interrupter is fixable in a centered manner between the two uprights by specific upper and lower connectors.

10. The method according to claim 1, wherein the two uprights and the plurality of vacuum interrupters each covering the range of different voltages and currents are included in a kit, the kit further including a plurality of upper and lower connectors.

11. A power breaking pole for an electric switching device, the power breaking pole comprising:

a vacuum interrupter, which extends along an elongation axis called an axis XX', and which is equipped with a lower end and an upper end in alignment with the axis XX';

two uprights placed symmetrically with respect to a main plane P of the vacuum interrupter, the two uprights being supplied with an upper holder and a lower holder; and a lower connector and an upper connector, which are electrically linked to the lower end and to the upper end, respectively, the upper and lower connectors being fixed to the upper holder and the lower holder, respectively, such as to rigidly hold the two uprights together, the upper and lower connectors also holding the vacuum interrupter in a centered manner between the two uprights, the upper holder and the lower holder also being arranged to allow the upper and lower connectors to hold vacuum interrupters with different lengths along the axis XX'.

12. The power breaking pole according to claim 11, wherein the upper holder and the lower holder comprise, on each upright, an upper section and a lower section, each upper or lower section comprising two mainly parallel faces called a lower face and an upper face, respectively, and which are perpendicular to the axis XX'.

13. The power breaking pole according to claim 12, wherein the upper connector is mounted to bear either against the upper face or against the lower face of the two upper sections depending on a length of the vacuum interrupter chosen.

14. The power breaking pole according to claim 12, wherein the lower connector is mounted to bear either against the upper face or against the lower face of the two lower sections depending on a length, along the axis XX', of the vacuum interrupter chosen.

15. The power breaking pole according to claim 11, wherein at least one of the two connectors does not extend beyond the two uprights in a direction perpendicular to the axis XX', the lower connector being sandwiched between the two uprights.

16. A method comprising:

assembling a power breaking pole using two uprights supplied with an upper holder and a lower holder, a vacuum interrupter chosen from a plurality of vacuum interrupters each covering a range of different voltages and currents, each comprising an upper end and a lower end and extending along an elongation axis, called an axis XX', in alignment with the upper and lower ends, and two connectors, called an upper connector and a lower connector, respectively, which are specific to the vacuum interrupter chosen, the assembling including fixing the upper and lower connectors to the upper holder and the lower holder, respectively, such as to rigidly hold the two uprights together, the two connectors also holding, in a centered manner, the vacuum interrupter chosen between the two uprights, which are placed symmetrically with respect to a main plane P of the vacuum interrupter, the upper holder and the lower holder also being arranged to allow the two connectors to hold vacuum interrupters with different lengths, along the axis XX'.

* * * * *